US006470592B2

(12) United States Patent
Akimoto et al.

(10) Patent No.: US 6,470,592 B2
(45) Date of Patent: Oct. 29, 2002

(54) METHOD AND APPARATUS FOR FREEZE-DRYING OF FOODS, MEDICAMENTS, ETC.

(75) Inventors: Hiromiti Akimoto, Tokyo (JP); Ryouji Sunama, Tokyo (JP)

(73) Assignee: Kyowa Vacuum Engineering, Ltd., Tokyo (JP)

( * ) Notice: Subject to any disclaimer, the term of this patent is extended or adjusted under 35 U.S.C. 154(b) by 0 days.

(21) Appl. No.: 09/797,834

(22) Filed: Mar. 5, 2001

(65) Prior Publication Data

US 2002/0050072 A1 May 2, 2002

(30) Foreign Application Priority Data

Oct. 30, 2000 (JP) ..... 2000-330637

(51) Int. Cl.[7] ..... F26B 5/06

(52) U.S. Cl. ..... 34/92; 34/284; 34/287; 34/288; 34/290; 34/291; 34/297; 34/384; 34/578; 34/176; 34/179; 34/181

(58) Field of Search ..... 34/284, 285, 286, 34/287, 288, 290, 291, 294, 295, 296, 297, 298, 299, 300, 376, 380, 381, 384, 385, 386, 576, 578, 586, 80, 176, 179, 180, 181, 182, 183, 92; 62/66–72

(56) References Cited

U.S. PATENT DOCUMENTS

| | | | | | |
|---|---|---|---|---|---|
| 2,402,401 | A | * | 6/1946 | Hickman | 34/5 |
| 3,132,929 | A | * | 5/1964 | Thuse | 34/77 |
| 3,198,492 | A | * | 8/1965 | Schneider | 259/95 |
| 3,396,475 | A | * | 8/1968 | Schiebel | 34/5 |
| 3,759,047 | A | * | 9/1973 | King et al. | 62/66 |
| 4,561,191 | A | * | 12/1985 | Parkinson | 34/5 |
| 4,802,286 | A | * | 2/1989 | Kobayashi et al. | 34/15 |
| 5,035,065 | A | * | 7/1991 | Parkinson | 34/92 |
| 5,090,132 | A | * | 2/1992 | Kobayashi et al. | 34/5 |
| 5,119,640 | A | * | 6/1992 | Conrad | 62/272 |
| 5,208,998 | A | * | 5/1993 | Oyler | 34/5 |
| 6,256,902 | B1 | * | 7/2001 | Flaherty et al. | 34/379 |

* cited by examiner

*Primary Examiner*—Ira S. Lazarus
*Assistant Examiner*—K. B. Rinehart
(74) *Attorney, Agent, or Firm*—Browdy and Neimark, PLLC

(57) ABSTRACT

A process is provided for freeze-drying medicaments and foodstuffs comprising dissolving the foodstuffs or medicaments in a solvent, introducing the solution formed into a shell comprising a desiccating chamber of a shell-tube freeze-drying device to cause the solution to freeze in a tubular layer, and crushing and comminuting the freeze-dried liquid with a comminuting device to obtain a powder product.

7 Claims, 9 Drawing Sheets

METHOD AND APPARATUS FOR FREEZE-DRYING OF FOODS, MEDICAMENTS, ETC.

BACKGROUND OF THE INVENTION a) Field of the Invention

This invention relates to a method for freeze-drying of foodstuffs, medicaments, etc. to obtain such products in their desiccated form by first adjusting the starting materials for such foodstuffs, medicaments, etc. in their liquid form, and then freeze-drying such liquid material into the final desiccated powder products. This invention is also concerned with a system for attaining such freeze-drying of foodstuffs, medicaments, and so forth.

b) Description of Prior Arts

Conventionally, the system for freeze-drying (or lyophilizing) foodstuffs, medicaments, etc., by which the materials therefor in liquid form are subjected to freeze-drying through sublimation heat supplied under the vacuum condition, is usually constructed in such a manner that the material to be dried is filled, in its liquid form, in a desiccating vessel such as tray, and the like, then such tray with the material to be dried is placed in a desiccating chamber of a freeze-drying device provided with a stack of shelves, thereafter the material is freeze-dried in bulk form, and, after drying, the material as dried is comminuted by a pulverizer, the final product in powder form being collected into a receptacle.

More concretely, this conventional freeze-drying apparatus is made up of the following elements, taking a currently implemented apparatus for the production of medicaments, as an example. That is to say, referring to FIG. 1 of the accompanying drawing, a block enclosed by a double-dot-and-dash line (I) designates an apparatus A for adjusting starting materials, which performs a step of adjusting the starting materials into a liquid form (it being understood that, throughout this description, 'slurry' will also be included in this category of liquid material). This materials adjusting apparatus A is constituted with a plurality of mutually juxtaposed blending tanks a, a, . . . and an adjusting tank b. A predetermined quantity of such starting material as weighed is poured by human hands into the blending tanks a, a, . . . , together with a solvent (distilled water) through the charging port 10 of each of them, followed by operating agitators 11, 11, . . . installed in the blending tanks a, a, . . . by means of motors 12, 12, . . . equipped on each agitator, thereby effecting blending of the materials, as charged, through agitation to cause the starting materials and the solvent to be made into a liquid material. This liquid material is then charged into the adjusting tank b through a charging port 20 of the adjusting tank b by human hands, while, at the same time, a predetermined quantity of the solvent (distilled water) is further poured therein. Subsequently, an agitator 21 installed in the adjusting tank b is operated by a motor 22 to blend the materials in liquid form by agitation to adjust it into the liquid material of a predetermined composition. As soon as this adjusting operation is completed, the liquid material as adjusted is let out of the discharge port 23 at the bottom of the adjusting tank b by the action of a pump P connected to the discharge port 23 through a pipeline. It should be noted that this liquid material as adjusted is transferred to the subsequent step of 'distributive pouring' through a pipeline c provided with a sterilized filter and connected to the discharge port of the pump P.

Again, in reference to FIG. 1, a block enclosed by a double-dot-and-dash line (II) designates the distributive pouring (or feeding) apparatus B which performs the distributive pouring step to distribute the liquid material as adjusted in the abovementioned step of adjusting the materials. This distributive pouring apparatus is constituted with a distributive pouring tank d connected to the downstream side of the abovementioned pipeline c; a pipeline 31 for the distributive pouring, connected to its discharge port through a sterilized filter 30; and a loading device (not shown in the drawing) which is disposed below the discharge port 32 of the pipeline 31 so as to sequentially carry into, or carry out, a desiccating vessel e, such as tray, etc., into which the liquid material to be discharged from the distributive pipeline 31 is poured; and so forth.

In this figure of drawing, a block surrounded by a double-dot-and-dash line (III) refers to a freeze-drying apparatus C to perform the freeze-drying of the liquid material. This freeze-drying apparatus comprises a freeze-drying device f with stack of shelves, which functions to introduce the desiccating vessels e, e, . . . , each being filled with the liquid material, into the desiccating chamber for its freeze-drying. In the front face 40 of the storage chamber for the freeze-drying device f, there is formed, in a freely openable and closable manner, an opening 41, through which the desiccating vessels e, e, . . . are introduced into, or taken out of, the freeze-drying apparatus. Further, in the front face side of the opening 41, there is provided the loading apparatus (not shown in the drawing) for performing the introduction and removal of the desiccating vessels e, e, . . . , each being filled with the liquid material. In addition, an isolating device or an isolator (not shown in the drawing) for preventing contamination is provided between the blocks (II) and (III).

In the same drawing, a block surrounded by a double-dot-and-dash line (IV) designates a crushing and comminuting apparatus D which performs a step of crushing and pulverizing the desiccated product (in bulk) from the liquid material which has been subjected to the freeze-drying in the desiccating chamber 40 of the freeze-drying device f. This pulverizing apparatus D is constituted with a comminuting device g made up of a continuous series of: a power mill 51 to receive therein a bulk of the liquid material solidified in the desiccating vessels e, e, . . . through a hopper 50; a jet mill 52 for comminuting the crushed product; and a cyclone 53 which separates the comminuted product discharged from the jet mill 52 into powder and air. At the lower discharge port of the cyclone 53, there is disposed a receptacle h for receiving thereinto the powder product to be taken out of the discharge port. Further, in the vicinity of the hopper 50 of the comminuting device g, there is provided a loading device (not shown in the drawing), or a feeder device, for throwing into the hopper 50, the dried product which is solidified in the interior of the desiccating vessels e, e, . . . , into which the material to be dried has been transported.

In the same drawing, too, a block surrounded by a double-dot-and-dash line (V) designates a washing and sterilizing apparatus E for washing and sterilizing the desiccating vessels e, e, . . . which are used by filling the liquid material therein and loaded in the freeze-drying device f The washing and sterilizing device is constructed with the washing device i for washing the desiccating vessels e, e, . . . , and the sterilizing device j for sterilizing the desiccating vessels as washed. The loading apparatus (not shown in the drawing) is disposed at each of the charging ports and the take-out ports of the desiccating vessels e, e, . . . .

Thus, the final powder product is obtained by and through each of these blocks, i.e., the material adjusting step where the liquid material is adjusted by the material adjusting device A; distributive pouring (or feeding) step where the liquid material as adjusted in the preceding step is distributively fed into the desiccating vessels e, e, . . . which have been sterilized in the sterilizing step so as to fill the material in each of these vessels; the desiccating step where the desiccating vessels e, e, . . . filled with the liquid material are placed in the freeze-drying apparatus for freeze-drying of the liquid material; and the crushing (or grinding) step where the dried products (in bulk form) from the liquid material solidified in the desiccating vessels e, e, . . . are thrown into the comminuting device g to comminute the desiccated material into the final product in fine powder. Each of these process steps is effected in a clean room, where a ratio of the floating quantity of the minute particles is regulated. Furthermore, various operations such as the loading and removing of the desiccating vessels e, e, . . . , as washed, onto and from the sterilizing device j; the distributive pouring and filling of the liquid material into the desiccating vessels e, e, . . . ; the loading of the desiccating vessels e, e, . . . filled with the liquid material into the freeze-drying device f; the removing of the desiccating vessels e, e, . . . which have completed desiccation of the liquid material from the freeze-drying device; the removing of the dried product (in bulk form) of the liquid material from the desiccating vessels e, e, . . . , and the throwing of the dried product into the comminuting device g; the separation of the treated product, which has been subjected to comminution, into the final powder product and air, so as to take out the powder product alone; and other operations, are effected in clean booths k, k . . . , each of which encloses each and every operational space.

In the abovementioned means for making the powder product by adjusting the starting materials into the liquid material of a predetermined composition, desiccating the liquid material by the freeze-drying device, and comminuting the thus freeze-dried liquid material into the required powder product, since each of these process steps (i.e., material adjusting step, distributive feeding step, desiccating step, comminuting step, etc.) is independent of the other, and moreover, since human being or robot (manipulator) intervenes for carrying out the operations in each process step, there has been a problem such that it is troublesome to carry out each and every process step as well as connection of the adjacent process steps in the clean room satisfying various rules and regulations for the purpose of securing perfect sterilization of the ultimate powder product and of preventing the powder product from the risk of contamination from outside, which involves a great deal of investment for the construction of the facility.

The present invention has been made with a view to solving the above-described various problems inherent in the conventional system, and aims at providing improved means for enabling the sterilized condition of the powder product to be maintained as well as prevention of the risk of its contamination from the external atmosphere to be effectively secured. The invention is also to provide a novel expedient for enabling the entire process steps to be continuously operable in the form of a closed system. Such process steps can be realized in the freeze-drying system for obtaining an intended powder product through the process steps of: adjusting starting materials into a liquid form; distributively feeding the thus adjusted liquid material for its freeze-drying; desiccating the liquid material by the freeze-drying device; comminuting the thus desiccated liquid material by a comminuting device; and so forth, wherein the connected parts between the mutually adjacent process steps are brought to a condition, in which the continuous operations of the process step are made possible, thereby enabling the whole process steps to be isolated from the external atmosphere.

SUMMARY OF THE INVENTION

In view of the above-described points of problem, which are inherent in the conventional freeze-drying method and apparatus, it is a primary object of the present invention to provide a method for freeze-drying foodstuffs, medicaments, etc., which comprises steps of: adjusting starting materials and a solvent therefor into a liquid material by means of a material adjusting apparatus A made up of blending tanks a, a, . . . , an adjusting tank b, and so forth; introducing the liquid material into a shell 60 constituting a desiccating chamber of a shell-tube type freeze-drying device f through a pipeline c to immediately and distributively feed said liquid material into a plurality of tubes 61, 61, . . . which are juxtaposed each other in the upright position within the shell 60, to cause the liquid material to freeze in a tubular layer; and, after freeze-drying of the liquid material by a freeze-drying device, subjecting the thus freeze-dried tubular product, dropping from the tubes 61, 61, . . . within the shell 60, to the comminuting treatment by a comminuting device g into the ultimate powder product.

It is another object of the present invention to provide a method for freeze-drying foodstuffs, medicaments, etc., which comprises steps of: adjusting starting materials and a solvent therefor into a liquid material by means of a material adjusting apparatus A made up of blending tanks a, a, . . . , an adjusting tank b, and so forth; introducing the liquid material into a shell 60 constituting a desiccating chamber of a shell-tube type freeze-drying device f through a pipeline c to immediately and distributively feed the liquid material into a plurality of tubes 61, 61, . . . , which are juxtaposed each other in the upright position within the shell 60 to cause the liquid material to freeze in a tubular layer; and, after freeze-drying of the liquid material by the freeze-drying device, subjecting the thus freeze-dried tubular product, dropping from the tubes 61, 61, . . . within the shell 60, to the comminuting treatment by a crushing (grinding) device w disposed in a receptacle 72 for the desiccated product, placed below the shell 60 in continuation to this shell 60 while maintaining the vacuum condition; and forwarding the tubular desiccated product into a comminuting device g connected to the bottom surface side of the desiccated product receptacle 72 for the comminuting treatment to render the same to be the ultimate powder product.

It is still another object of the present invention to provide a freeze-drying apparatus for foodstuffs, medicaments, and so forth, which comprises: a distributor 80 for distributively feeding a liquid material into a plurality of tubes 61, 61, . . . above a shell 60 constituting a desiccating chamber of a shell-tube type freeze-drying device f, the tubes being juxtaposed each other in the upright position within the shell 60, the downstream side of the pipeline c to guide the liquid material from the adjusting tank b of the material adjusting apparatus A being connected to distributor 80 directly or through an atomizing nozzle.

It is other object of the present invention to provide a freeze-drying apparatus for foodstuffs, medicaments, and so forth, which comprises: an atomizing nozzle pipe 110 having a small diameter, which is disposed at the axial center position within the inner bore of a plurality of tubes 61, 61, . . . , which are juxtaposed each other in the upright position within the shell 60 constituting a desiccating chamber of a shell-tube type freeze-drying device f, a multitude of atomizing holes 111, 111, . . . being perforated in the cylindrical wall of the tubes, and the downstream side of the pipeline c to guide the liquid material from the adjusting tank b of the material adjusting apparatus A being connected to the upper end side of the atomizing nozzle pipes 110, 110, . . . , either directly or through the atomizing nozzle pipes.

It is still other object of the present invention to provide a freeze-drying apparatus for foodstuffs, medicaments, and so forth, which comprises: supporting rods 120, 120, . . . of a small diameter, which are disposed at the axial center position within each inner bore of a plurality of tubes 61, 61, . . . , which are juxtaposed each other in the upright position within the shell 60 constituting a desiccating chamber of a shell-tube type freeze-drying device, a small-sized holding rack 70*b*, formed in the shape of a opening-and-closing butterfly valve, to support the lower end side of the frozen layer of the liquid material, which has been subjected to the freeze-drying in a tubular shape within each of the tubes 61, 61, . . . , being supported onto each of the lower end parts of the supporting rods 120, 120, . . . , and an operating wire or pneumatically operated actuator for rotating these holding racks pneumatically operated actuator for rotating these holding racks 70, 70, . . . individually for their open and close actions being connected to each of the holding racks in the butterfly valve shape.

It is a further object of the present invention to provide a freeze-drying apparatus for foodstuffs, medicaments, and so forth, which comprises: a liquid material feeding tube 65, disposed at the lower surface side of the shell 60 constituting the desiccating chamber of the shell-tube type freeze-drying device f, the downstream side of which is communicatively connected to each of the lower end of a plurality of tubes 61, 61, . . . , which are juxtaposed each other in the upright position within the shell 60, the upstream side of this liquid material feeding tube 65 being connected and joined directly or through an atomizing nozzle, at the end part of the downstream side of the pipeline c which guides the liquid material from the adjusting tank b of the starting material adjusting apparatus A.

It is still further object of the present invention to provide a freeze-drying apparatus for foodstuffs, medicaments, and so forth, which comprises: a desiccated product receptacle 72 for receiving therein the desiccated product of the liquid material as dried by freezing the liquid material onto the wall surface of a plurality of tubes 61, 61, . . . , which are juxtaposed each other in the upright position within the shell 60, the desiccated product receptacle 72 being disposed below the shell 60 constituting the desiccating chamber of the shell-tube type freeze-drying device f, in a manner to be connected to said shell 60 and maintained in the vacuum condition; and a grinding device w for crushing the desiccated product falling into the desiccated product receptacle 72 from the tubes 61, 61, . . . within the shell 60, in the course of its falling or after its falling. freeze-drying apparatus for foodstuffs, medicaments, and so forth, which comprises: a desiccated product receptacle 72 for receiving therein the desiccated product of the liquid material as dried by freezing the liquid material onto the wall surface of a plurality of tubes 61, 61, . . . , which are juxtaposed each other in the upright position within the shell 60, the desiccated product receptacle 72 being disposed below the shell 60 constituting the desiccating chamber of the shell-tube type freeze-drying device f, in a manner to be connected to the shell 60 and maintained in the vacuum condition; and a crushing device w disposed in the desiccated product receptacle 72 for crushing the desiccated product dropping into the desiccated product receptacle 72 from the tubes 61, 61, . . . within the shell 60, the bottom surface side of said desiccated product receptacle 72 being air-tightly connected to the hopper 50 of the comminuting device g through a special valve 83 provided with a material forwarding device.

The foregoing objects, other objects as well as specific construction of the shell-tube type freeze-drying system according to the present invention will become more apparent and understandable from the following detailed description of the preferred embodiments thereof, when read in conjunction with the accompanying drawing.

BRIEF DESCRIPTION OF THE ACCOMPANYING DRAWING

In the accompanying drawing:

FIG. 1 is a schematic developed diagram for explaining, respectively, the step of adjusting starting materials into a required liquid material; the step of distributive feeding of the thus adjusted liquid material into desiccating vessels; the step of desiccating the liquid material by loading the desiccating vessels into the freeze-drying device; and the step of crushing and comminuting the thus desiccated product, after completion of its desiccation, by removing the desiccating vessels out of the freeze-drying device, and throwing the desiccated product, which has been solidified and adhered onto the interior of the vessels, into a grinding device to render the same to be fine powder product;

DETAILED DESCRIPTION OF PREFERRED EMBODIMENTS

Figure 1:
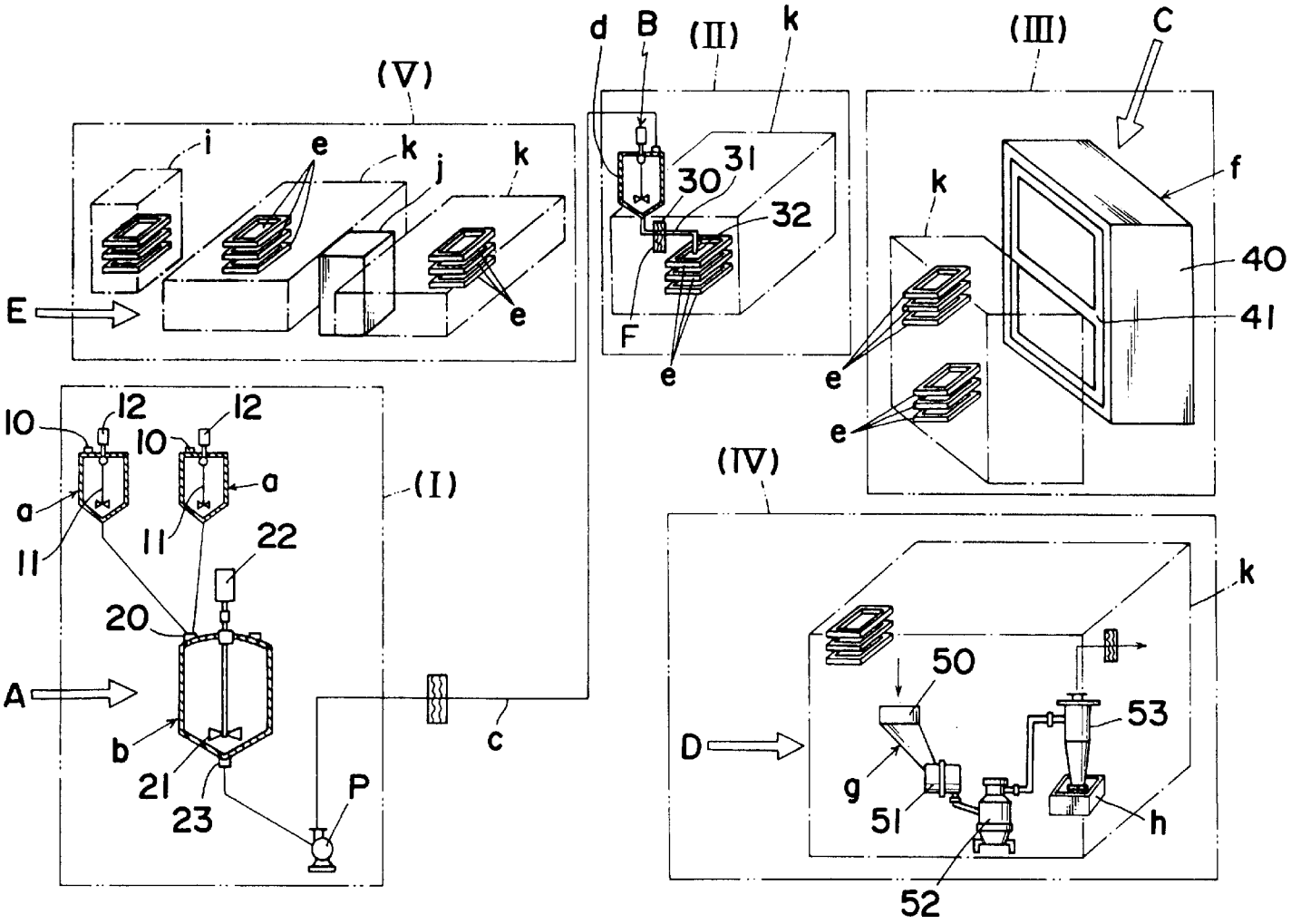

According to the present invention, the installation for carrying out the step of adjusting the starting materials to adjust the same into a liquid material of a predetermined composition (here, taking an installation for carrying out the step of rendering the starting materials to be the liquid material of a predetermined composition, where a medicinal composition is processed into desiccated powder product, as an example) may be such that, as has been done conventionally, a plurality of blending tanks a, a, . . . and an adjusting tank b are installed within a clean room, as shown by the block diagram enclosed by the double-dot-and-dash line (I) in FIG. 1, to be maintained at a predetermined degree of cleanliness in accordance with the laws and regulations, in the clean room of which the weighing of the starting materials and the charging of the thus weighed starting materials into the blending tanks a, a, . . . are carried out by human hands, through the charging port 10 of each of them; that a predetermined quantity of distilled water, as the solvent, was further poured into these blending tanks a, a, . . . ; that agitators 11, 11, . . . which are additionally provided in these blending tanks a, a, . . . are then actuated by driving the motors 12, 12, . . . to blend the starting materials and the solvent into the liquid material having the adjusted composition; that the thus adjusted liquid materials are subsequently charged into the adjusting tank b by human hands through the feeding port 20 of the adjusting tank b, with further addition of distilled water in a predetermined quantity; that the agitator 21 provided in this adjusting tank b is subsequently operated by driving the motor 22, thereby preparing the liquid material into slurry of a predetermined composition; that, as soon as preparation of the slurry is completed, it is pumped out of the bottom part of the adjusting tank b by actuating the pump P; and that the thus pumped out slurry is forwarded into the next distributive pouring (feeding) step through the pipeline c provided with a sterilized filter, and connected to the outlet port of the pump P.

In this case, the freeze-drying device f to be used for lyophilizing this liquid material, which has been prepared in the adjusting tank b, is of a shell-tube type freeze-drying device f.

This type of freeze-drying apparatus was previously invented and developed by the applicant of this application filed in Japan, and already patented under Japanese Patent No. 1788379 (Japanese Patent Publn. No. 4-78909), wherein a cooling surface of the freeze-drying device, having its dual function to serve as the heating surface for supplying heat to the material to be freeze-dried, is constructed in a vertical tube (cylinder) extending along the vertical plane, and a partition wall of the desiccating chamber to accommodate therein the vertical tubes is made to conform to the vertical shell (cylindrical body), thereby enabling the inner bore of the shell as the desiccating chamber to be communicatively connected to a vacuum exhaust system so as to make it evacuable into the vacuum, and, at the same time, to be communicatively connected to a trapping chamber, in which a trap (a vapor condenser) is provided to maintain the vacuum condition by collecting water vapor which is sublimated from the material to be desiccated due to heating, thereby causing the thus adjusted liquid material to be adhered onto the inner wall surface or the outer wall surface of the tube, in the form of a frozen layer, followed by desiccating this frozen layer.

Figure 2:
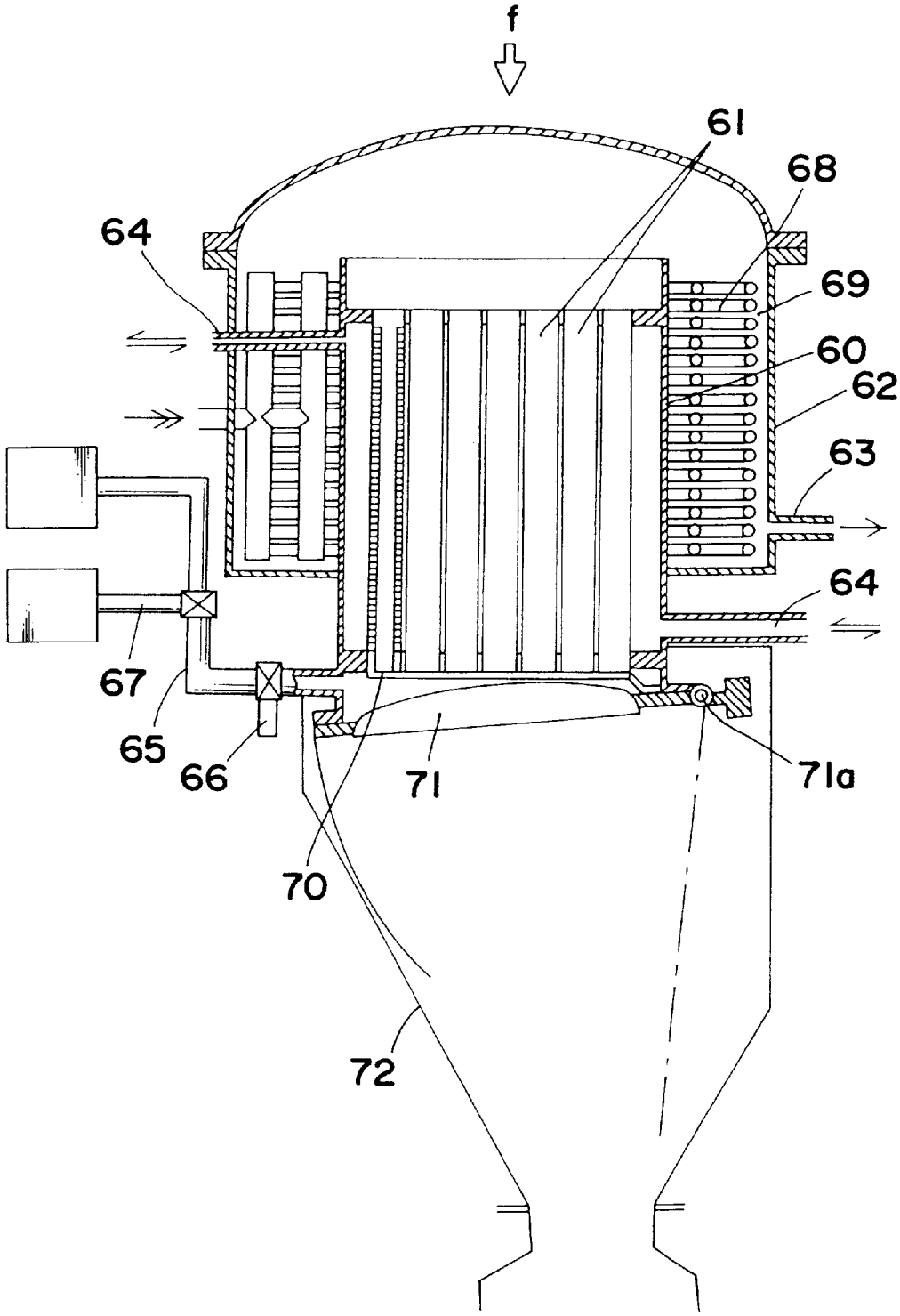
FIG. 2 is a longitudinal cross-sectional view showing the principal part of the shell-tube type freeze-drying device to be used for the practice of the present invention.

FIG. 2 illustrates one embodiment of this shell-tube type freeze-drying device f. In the drawing, a reference numeral 60 designates a shell to constitute the desiccating chamber formed in the cylindrical shape, of which the axial line thereof takes the vertical direction; reference numerals 61, 61, . . . denote a plurality of tubes disposed in the inner bore of the abovementioned shell 60, each of the tubes being formed in the upright cylindrical form and juxtaposed each other, with its axial line taking the vertical direction; a reference numeral 62 designates an outer cylinder which surrounds the shell 60; a reference numeral 63 denotes a pipeline disposed in one part of the outer cylinder 62 in a manner to maintain the inner bore of the shell 60 to be the vacuum desiccating chamber by the action of the vacuum exhaust system due to communicative connection of the inner bore of the outer cylinder 62 to the vacuum exhaust system; a reference numeral 64 designates a feeding pipeline of a heat medium, which introduces the heat medium into the outer peripheral side of the abovementioned tubes 61, 61, . . . to enable the inner peripheral side of the tubes 61, 61, . . . to be heated or cooled; a numeral 65 refers to a feeding pipeline to feed the adjusted liquid material into the interior of the tubes 61, 61, . . . ; a numeral 66 refers to an exhaust pipeline to discharge the unfrozen liquid, when the feeding liquid material is frozen in the form of a tubular layer of a predetermined thickness on the inner side of the tubes 61, 61, . . . ; a reference numeral 67 denotes a water supply pipeline for supplying distilled water to be frozen into ice film on the inner wall surface of the tubes 61, 61, . . . in utilization of the abovementioned feeding pipeline 65 and the exhaust pipeline, before the liquid material is supplied into the tubes 61, 61, . . . ; a numeral 68 refers to traps for collecting the water vapor to maintain the vacuum condition, which is sublimated from the material for desiccation, which is frozen inside the tubes 61, 61, . . . ; a numeral 69 refers to a trapping chamber formed between the outer peripheral side of the shell 60 and the inner peripheral side of the outer cylinder 62 so as to dispose the traps 68 therein; a reference numeral 70 designates a holding rack provided on the bottom surface side of the shell 60 for preventing the material to be desiccated in the form of the frozen layer from being exfoliated out of the inner surface of the tubes 61, 61, . . . to drop downward, when the ice film formed by freezing on the inner surface of the tubes 61, 61, . . . disappears on account of progress in the desiccation; a reference numeral 71 denotes a valve, which freely opens and closes the bottom surface of the shell 60; a numeral 72 refers to a receptacle in the form of a chute, which is connected to the bottom surface side of the shell 60 so as to receive the dropping-down desiccated product of the material to be desiccated, when the bottom surface side of the shell 60 is opened by rotational opening of the abovementioned holding rack 70 and the opening-and-closing valve 71, at the end of the desiccating step. The shell-tube type freeze-drying device f of the above-described construction functions to charge, by freezing, the liquid material for desiccation, in the form of a frozen layer of a predetermined thickness, onto the inner surface side of the tubes 61, 61, . . . within the shell 60 to be the desiccating chamber, to which the sublimation heat of water vapor is supplied for freeze-drying, thereby taking the desiccated product out of the bottom surface side of the shell.

In some occasion, heating and cooling of the tubes 61, 61, . . . disposed in the shell 60 are effected by circulating the heating medium and the cooling medium, in and through the inner bore defined by forming the cylindrical wall of the tubes 61, 61, . . . in double shape so as to make the inner wall surface or the outer wall surface of the tube 61 to constitute the cooling-cum-heating surface, thereby forming the frozen layer of the liquid material for desiccation on the outer surface side of the tubes 61, 61, . . . .

Thus, in the freeze-drying device according to the present invention, the liquid material adjusted in the material adjusting tank b in the starting materials adjusting apparatus A is subjected to freeze-drying by use of the shell-tube type freeze-drying device f, as has been described in the foregoing, at which time the liquid material to be sent out of the adjusting tank b through the pipeline c provided with the sterilized filter is directly introduced into the body of the freeze-drying device f, so that it may be distributively fed into the tubes 61, 61, . . . within the shell 60.

Thus, in order for the adjusted liquid material to 2 charged into the freeze-drying device f, the desiccating vessel per se for distributively pouring the liquid material should constitute the tubes 61, 61, . . . for freeze-drying the liquid material in the shell-tube type freeze-drying device f. As a consequence, the distributive pouring step for distributively feeding the adjusted liquid material in the material adjusting step is effected within the main body of the freeze-drying device f constituting the clean room, whereby the step of carrying the desiccating vessels into the desiccating chamber of the freeze-drying device f, to which the liquid material has been distributively fed during the distributive feeding step, can be done continuously within the main body of the freeze-drying device f constituting the clean room, with the further advantage such that both distributive feeding step and carrying step can be connected within the main body of the freeze-drying device f.

Figure 3:
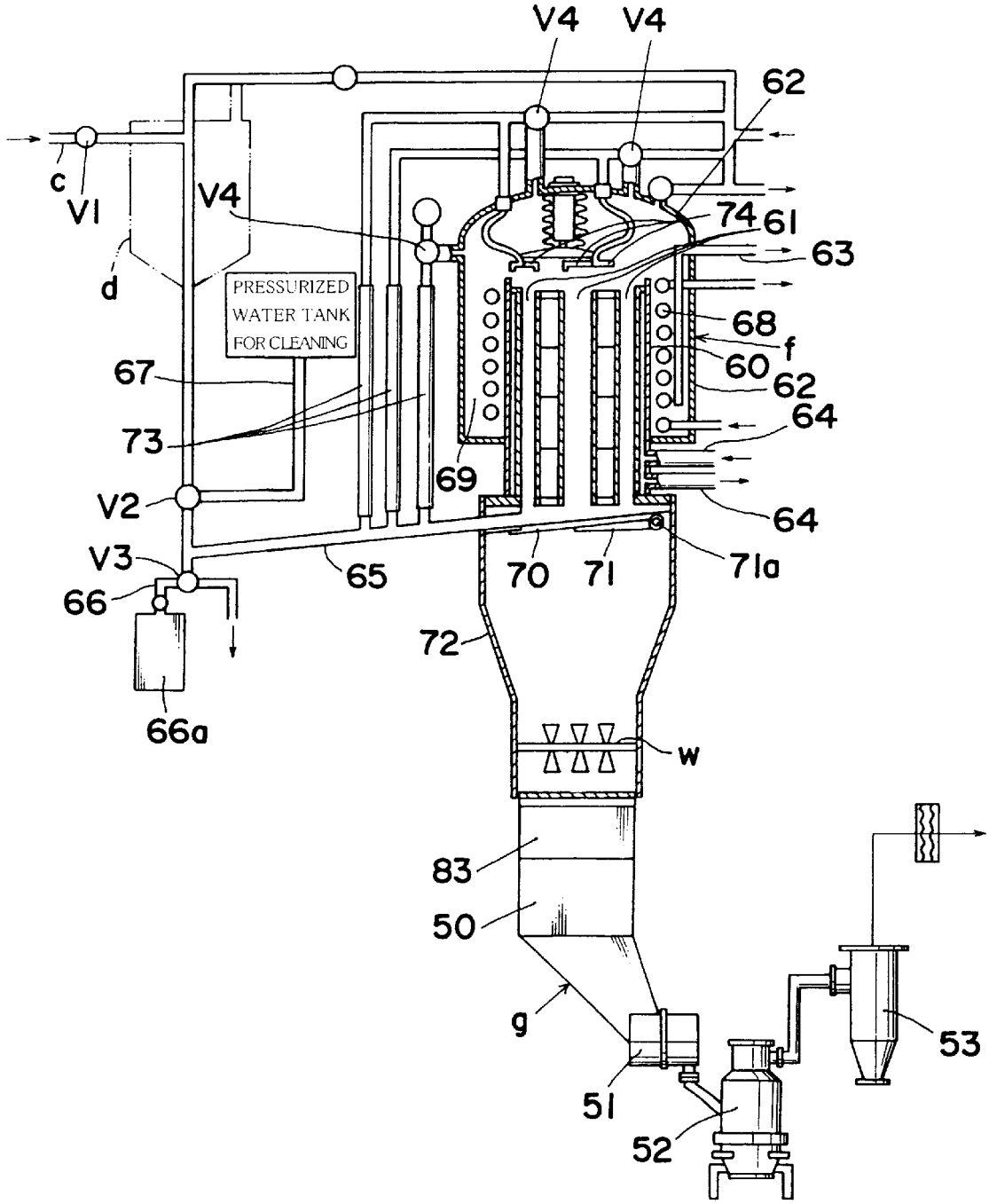
FIG. 3 is a side elevational view, partly cut away, of the principal part of the freeze-drying device to be used for the practice of the present invention, with the starting material adjusting device being omitted from illustration.

The distributive feeding of the liquid material into the tubes 61, 61, . . . of the shell-tube type freeze-drying device f, at this time, may be done, as shown in FIG. 3, by disposing the downstream side of the feeding pipeline 65 to supply the liquid material into the freeze-drying device f, on the bottom surface side of the shell 60 so as to communicatively connect its downstream side to each of the lower ends of a plurality of tubes 61, 61, . . . disposed in the shell 60, and, at the same time, water level gauges 73, 73, . . . , each corresponding to each of the tubes 61, 61, . . . , are connected to a portion projecting outside of the shell 60, while the upstream side of this feeding pipe 65 is connected to the end part of the downstream side of the pipeline c which sends out the adjusted liquid material to be pumped out by the pump P through the discharge port of the abovementioned adjusting tank b, by way of valves V1, V2, and V3. In other way, it may be feasible to carry out the distributive pouring of the liquid material sent out of the adjusting tank b through the pipeline c into the tubes 61, 61, . . . within the shell 60, by directly connecting and joining the pipeline with the distributive pouring tank d, as shown by the double-dot-and-dash line in FIG. 3, thereby distributively pouring the liquid material. By the way, reference numerals V4, V4, . . . designate change-over valves to carry out the sequential change-over control of the operation of each of the water level gauges 73, 73, . . . ; and a numeral 74 refers to an opening-and-closing valves to control opening and closing operations of the upper open end of each tube 61.

Figure 4:
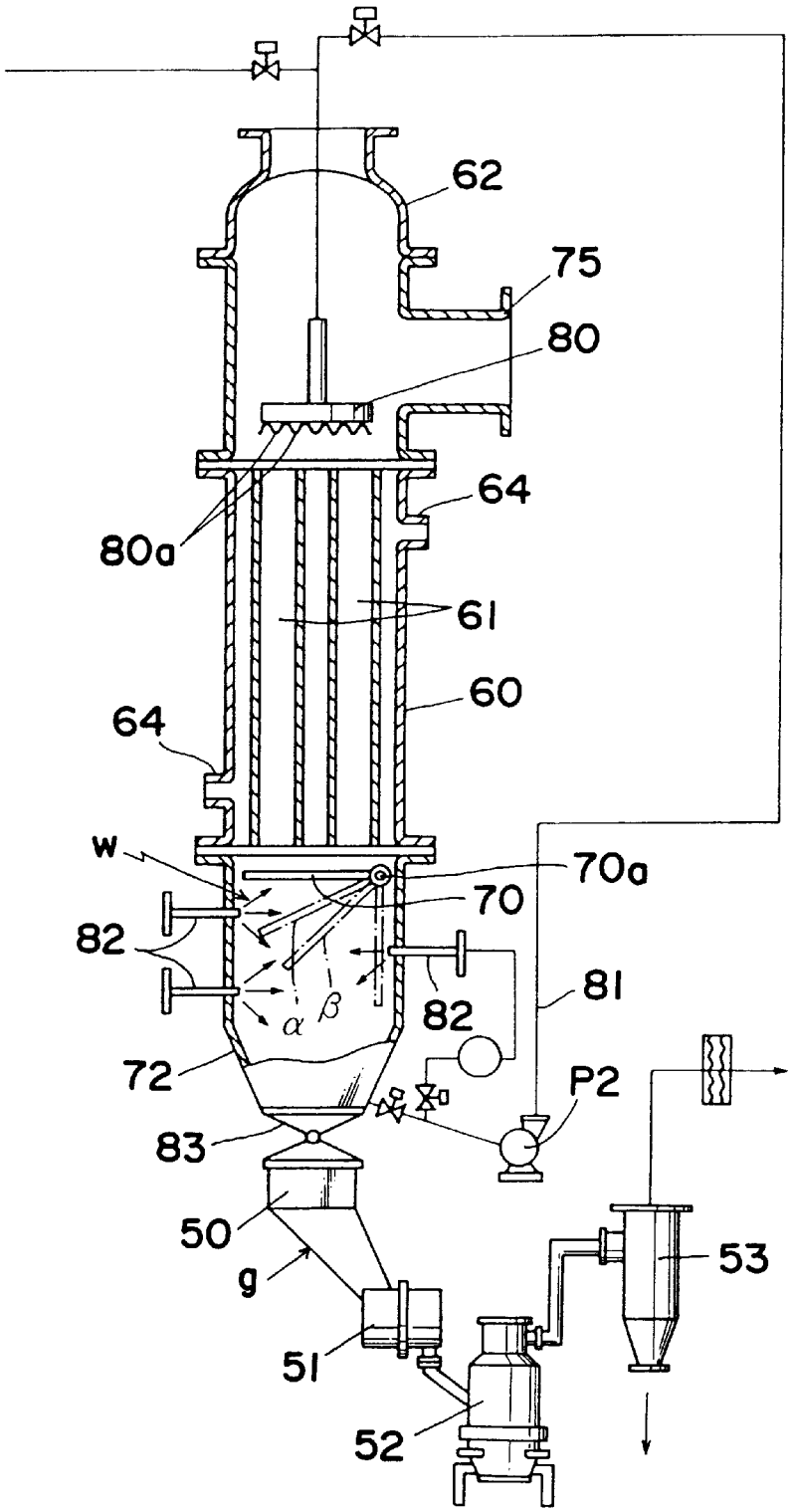
FIG. 4 is a side elevational view showing another embodiment of the freeze-drying device of the present invention, with one part thereof being cut away.

In the next place, FIG. 4 illustrates another embodiment, wherein the form of distributive feeding of the liquid material into the tubes 61, 61, . . . in the shell 60 is modified. In contrast to the preceding embodiment, wherein the liquid material is fed from the bottom surface side of the shell 60, this embodiment is made to distributively feed the liquid material into each of the tubes 61, 61, . . . from the upper surface side of the shell 60.

The freeze-drying device f in this embodiment of FIG. 4 is so constructed that the outer cylinder 62 is connected and joined to the upper surface side of the shell 60, in the form of a cap, and the connecting port 75 formed in one part of this outer cylinder 62 is further joined to a vacuum pump and a trapping chamber (both being not shown in the drawing), thereby maintaining the interior of the shell 60 in the vacuum condition.

Subsequently, a distributor 80 is disposed in this outer cylinder 62, which is connected with the pipeline c for leading the adjusted liquid material from the abovementioned adjusting tank b, and, by controlling the distributor 80, the liquid material is sequentially sprayed in its atomized form from a plurality of spray nozzles 80*a*, 80*a*, . . . provided on the lower surface side of the distributor 80, to thereby spray the liquid material onto each of the tubes 61, 61, . . . within the shell 60, thus realizing the distributive feeding of the liquid material.

Figure 7:
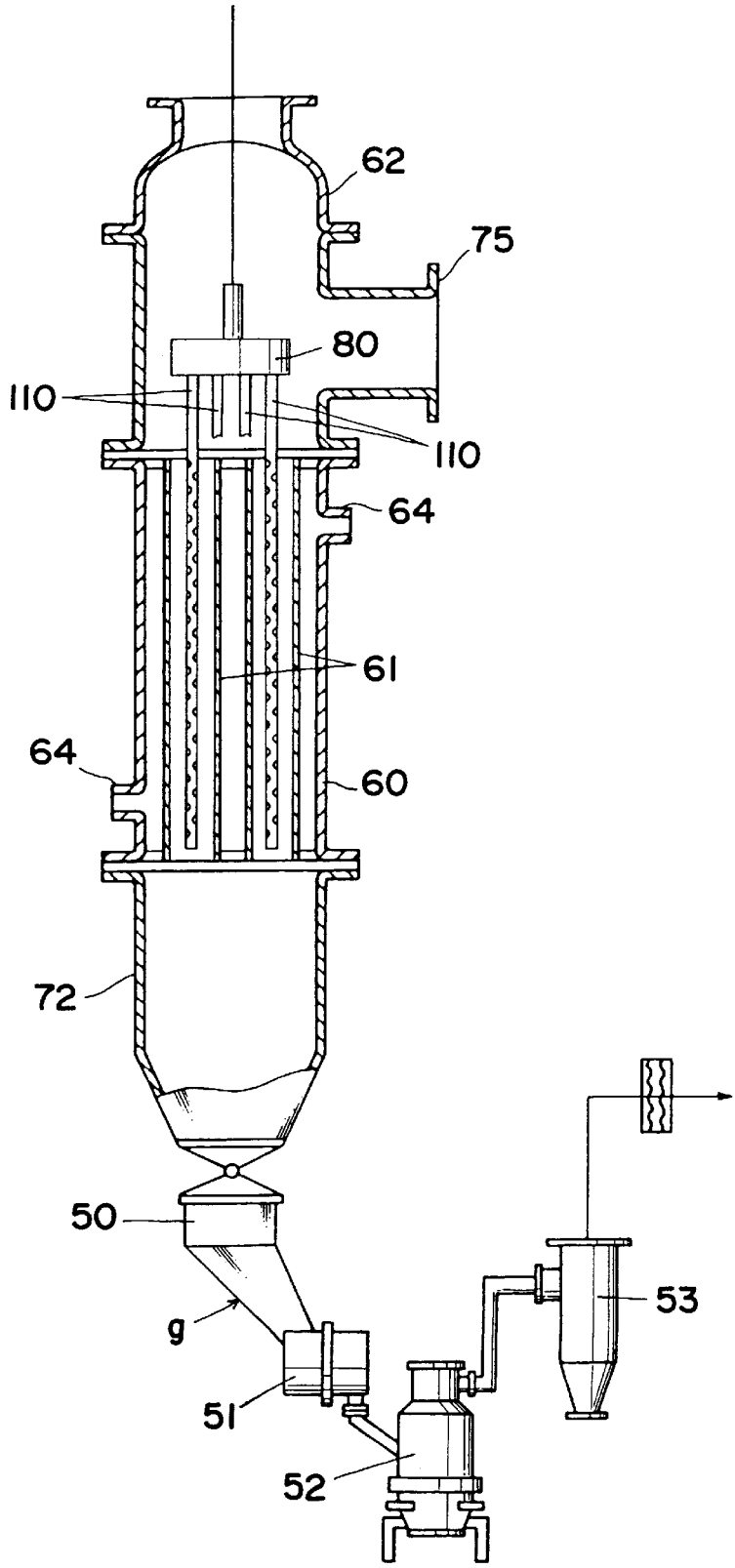
FIG. 7 is a side elevational view of other embodiment of the shell-tube type freeze-drying device of other embodiment of the present invention, with one portion of the principal part thereof being cut away.
Figure 8:
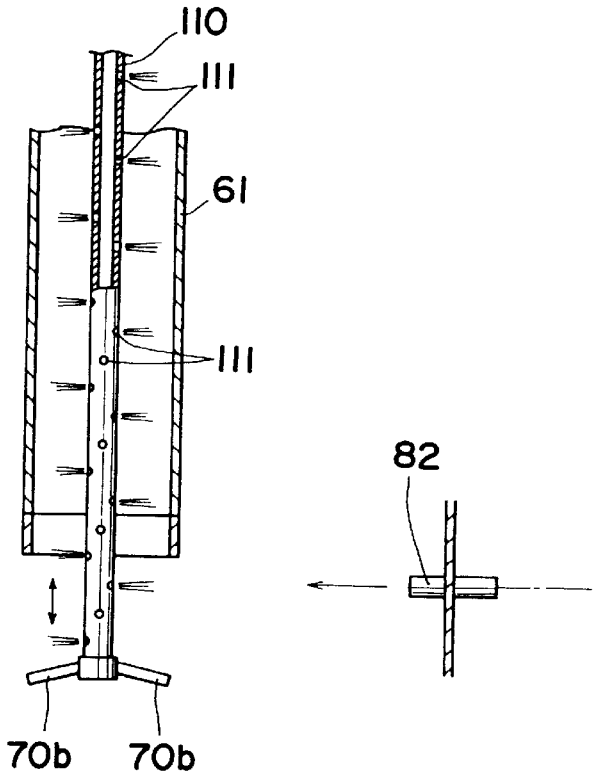
FIG. 8 is an enlarged side elevational view of the shell-tube type freeze-drying device according to the present invention, with one part thereof being cut away.

The spraying of the liquid material against the inner wall surface of each of the tubes 61, 61, . . . in this shell 60 is done by disposing spray nozzle pipes 110, 110, . . . of a small diameter at the axial center position of each of the tubes 61, 61, . . . , as shown in FIG. 7, and by perforating a multitude of atomizing nozzles 111, 111, . . . in the cylindrical wall of the spray nozzle pipes 110, 110, . . . , as shown in FIG. 8, to thereby connect the upper end of each of these atomizing nozzle pipes 110, 110, . . . with the distributor 80 disposed in the desiccating chamber above the shell 60, and to thereby spray the liquid material onto the inner wall surface of each of the tubes 61, 61, . . . from this nozzle pipe 110. In this case, the spray nozzle pipe 110 should advantageously be made movable in the up-and-down direction, or in the rotational direction, of the shell 60.

Figure 12:
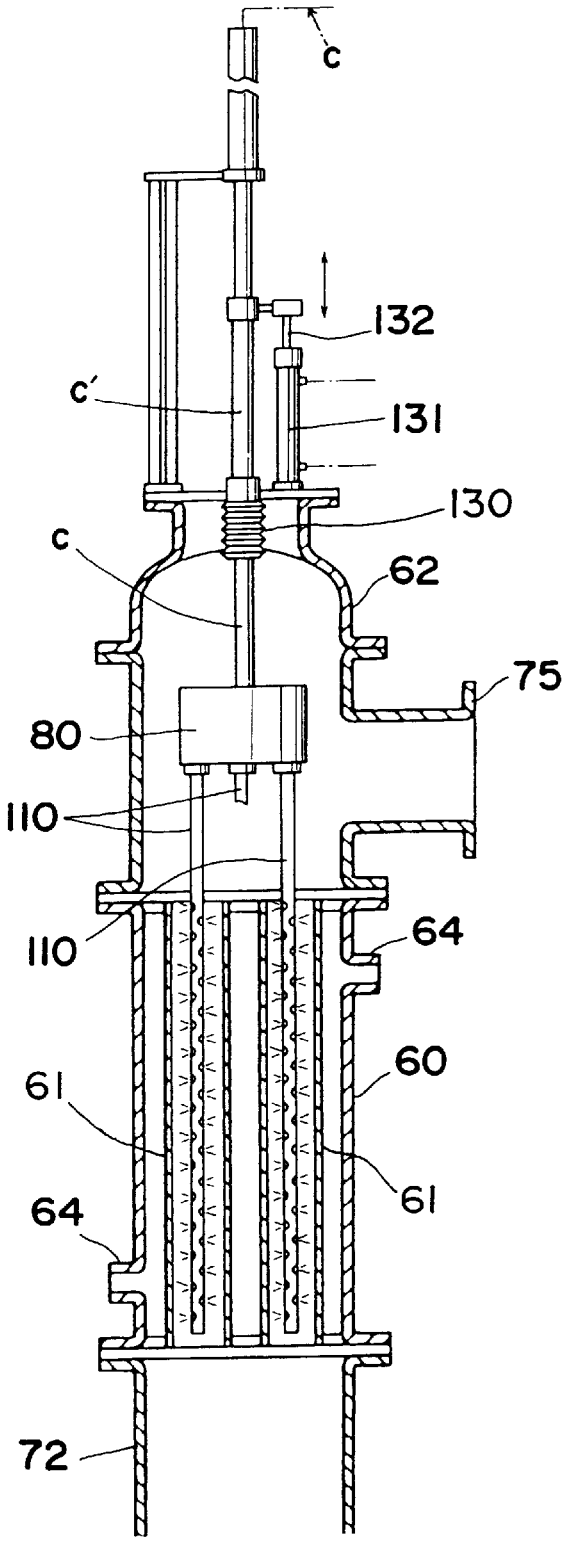
FIG. 12 is a side elevational view, partly in the longitudinal cross-section, of means for causing the atomizing nozzle pipes, disposed in the shell of the shell-tube type freeze-drying device, to move up and down.

This up-and-down movement (vertical movement) of the spray nozzle pipe 110 can be done arbitrarily by any means. For example, as shown in FIG. 12, when the end part of the pipeline c at its downstream side, through which to supply the liquid material, is connected to the distributor 80, from which are connectively depended a plurality of the spray nozzle pipes 110, 110 . . . , to the lower surface side, in correspondence to the mutually juxtaposed tubes 61, 61, . . . , the distributor 80 is positioned in a manner to be freely movable up and down to join the end part of the abovementioned pipeline c at its downstream side to the upper surface side of the distributor, to thereby support the distributor suspendedly at the end part of the pipeline c, while this pipeline is made to project from the ceiling part of the shell 60 in a state of its being hermetically held above the shell, and, at the same time, the pipeline is fitted to the ceiling part in a freely movable manner, up and down, and its fitted part is covered with a dust-preventing cover 130. In the meantime, the protruded part c' of the pipeline c which projects upwardly from the ceiling part is joined to a piston rod 132 of an air cylinder 131 which is to be mounted on the upper surface of the ceiling part of the shell 60, by the action of which the pipeline c and the distributor 80 together may be made movable up and down.

For the distributive feeding means, by which the liquid material is sprayed in its atomized form onto the wall surface of the tubes 61, 61, . . . , there is no need of providing an opening-and-closing valve 71 on the lower surface side of the shell 60, to shut the opening of the lower end of each of the tubes 61, 61, . . . within the shell 60 in a freely openable and closable manner, but the opening at the lower end of the tubes 61, 61, . . . in the shell 60 can only be maintained in its open state, and, when the frozen layer is formed on the inner wall surface of each of the tubes 61, 61, . . . by spraying the liquid material from the distributor 80 thereto, surplus unfrozen liquid material may be dropped downward, as the drain, through the opening at the lower end of the tubes 61, 61, . . . .

For this purpose, the construction of the freeze-drying apparatus is such that: the desiccated product receptacle 72 to be connectively provided on the lower surface side of the shell 60 is maintained in the vacuum condition in continuation to the shell 60, and a sanitary pump P2 to pump out the unfrozen liquid material collecting in the bottom part of the desiccated product receptacle 72 is connected to this receptacle, so that the unfrozen liquid material recovered by this sanitary pump P2 may be returned to the distributor 80 through the pipeline 81; and that, in advance of the liquid material being atomized, if and when the ice film formed by spraying and freezing distilled water onto the inner wall surface of the tubes 61, 61, . . . beforehand, in utilization of the distributor 80 or by use of a separately provided atomizing means, disappears due to progress in the desiccation, whereby the liquid material which has been frozen as the frozen layer on the inner wall surface of the tubes 61, 61, . . . becomes dropped off the interior of the tubes 61, 61, . . . , a holding rack 70 to sustain the frozen layer of this falling liquid material as freeze-dried rotates in the downward direction on the pivot of the hinge 71*a* within the desiccated product receptacle 72 which is maintained in the vacuum condition, whereby the lower part of the shell 60 is opened.

Figure 9:
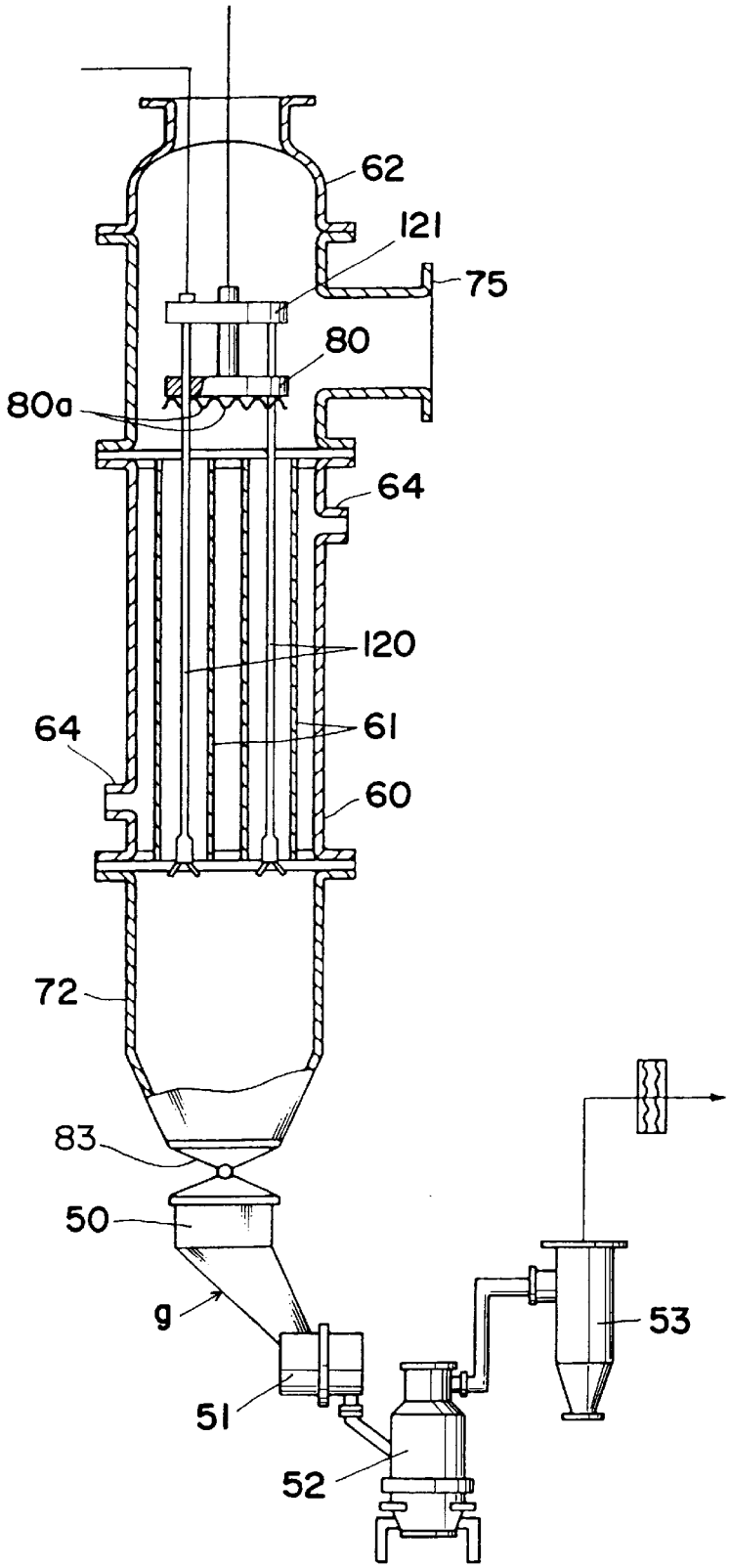
FIG. 9 is a longitudinal cross-sectional view showing the principal part of another embodiment of the shell-tube type freeze-drying device to be used for the practice of the present invention.

As shown in FIG. 9, this holding rack 70 may also be formed in a size substantially corresponding to the area of opening of the lower end of each of the tubes 61, 61, . . . which are mutually juxtaposed in the upright position within the shell 60, and an individual rack is disposed below the lower end of each of the tubes 61, 61, . . . so that the frozen layer of the liquid material may be maintained separately in the frozen state in each of the tubes 61, 61, . . . .

In this way, when the holding rack 70 is formed in a small size in correspondence to the diameter of the tube 61 so as to be held in each of the tubes 61, 61, . . . for each frozen layer, if and when the frozen layer of the liquid material becomes desiccated, the tubes are required to be opened and rotated to cause the frozen layer to drop. For this purpose, there is disposed, at the axial center position within each tube 61, a supporting rod 120 in the form of a rod having a very small diameter, or in the form of a hollow pipe with its outer diameter being of an order of approximately 10 mm or so, when the inner diameter of the tube 61 is made to be approximately 100 mm, while the upper end side of each of the supporting rods is connected with, and supportively hung from, the distributor 80 or the supporting member 121 to be disposed above the shell 60, and the holding rack 70 formed in a small size is supported on the lower end of each supporting rod 120.

Figure 10:
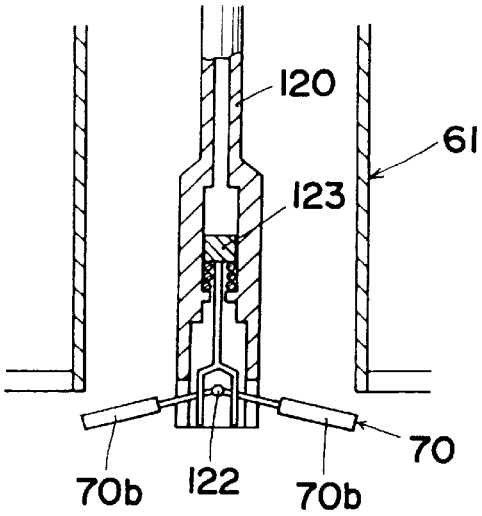
FIG. 10 is an enlarged side elevational view of the freeze-drying device shown in FIG. 9, with one part thereof being cut away.
Figure 11:
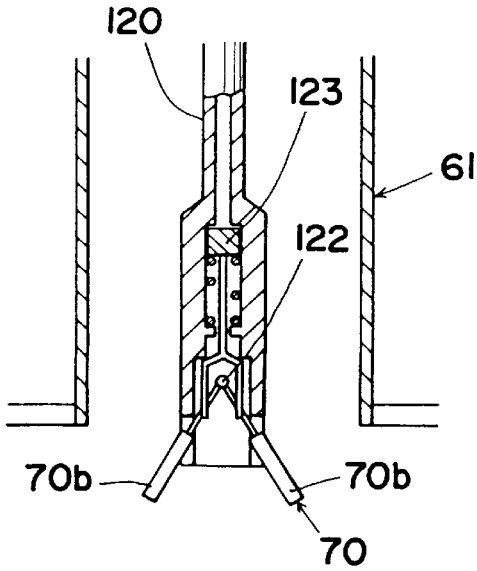
FIG. 11 is an explanatory diagram of the operation of the freeze-drying device shown in FIG. 10.

This holding rack 70 is divided into a plurality of split rack boards 70*b*, 70*b*, . . . , each of which is rotationally opened and closed around the pivotal shaft 122, as shown in FIG. 10, and the base end side of each of these split rack boards 70*b*, 70*b*, . . . is connected with the lower end side of the supporting rod 120 to be joined to an actuator 123 which moves up and down. By operating this actuator 123, using air pressure to be introduced into the inner bore of the supporting rod 120, or pushing and pulling of a wire, there may be realized a switch-over between the open state of the opening at the lower end of the tube 61 by being folded downward, as shown in FIG. 11, and the closed state of the opening at the lower end of the tube 61 by being expanded horizontally, as shown in FIG. 10.

In this expedient, the supporting rod 120 to be disposed within the tube 61 may be substituted by an atomizing nozzle pipe 110, as shown in FIG. 8, if and when such atomizing nozzle pipe is disposed at the axial center position within each of the tubes 61, 61, . . . .

In this case, as shown in the lower half side of FIG. 8, it is advantageous that the base end side of each of the abovementioned plurality of split rack boards 70*b*, 70*b*, . . . is fixedly mounted on the lower end part of each atomizing nozzle pipe 110 so as to cause these split rack boards 70*b*, 70*b*, . . . to protrude radially outwardly in the form of a propeller with its diameter being corresponded to the diameter of the tube 61; then, as mentioned in the foregoing, in utilization of the up-and-down movement of each atomizing nozzle pipe 110 for every distributor 80, these split rack boards 70*b*, 70*b*, . . . are so made as to descend into the desiccated product receptacle 72 through the opening at the lower end of the tube 61, by the descending movement of which the desiccated tubular product (in bulk), held in the tube, is gradually exposed to the desiccated product receptacle 72 from the interior of the tube 61, then compressed air ejected out of a jet nozzle 82 formed in the peripheral wall of the shell 60 is blown against the desiccated product to sequentially crush and comminute the exposed portion of the product so as to allow the minute powder product to fall downward.

Thus, in the freeze-drying device according to the present invention, the liquid material which has been adjusted in the adjusting tank b during the starting materials adjusting step, and is sent out of the adjusting tank through the pipeline c is distributively poured into the tubes 61, 61, . . . within the shell 60 in the main body of the shell-tube type freeze-drying device f, and this liquid material is subjected to freeze-drying, whereby the charging of the thus adjusted liquid material into the freeze-drying device f is completely isolated from the external atmosphere, so that the process step can be done without relying on the human power. In addition, the steps of removing, crushing, and comminuting the desiccated product from the liquid material which has completed its desiccation within the desiccating chamber of the freeze-drying device f are also made practicable within the chamber which is isolated from outside, and connected and joined integrally with the freeze-drying device, or through the atomizing nozzle.

For doing this, use is made of a phenomenon such that, when the liquid material to be desiccated in the tubes 61, 61, . . . in the shell 60 of the shell-tube type freeze-drying device f becomes desiccated due to progress in drying, it becomes the tubular desiccated product (in bulk form) which drops downward from within the tubes 61, 61, . . . . That is to say, when the tubular desiccated product (in bulk form) is caused to drop into the desiccated product receptacle 72 which is connected to the lower surface side of the shell 60 and maintained in the vacuum condition, the holding rack 70 to be provided on the lower surface side of the shell 60 is so controlled that it may be opened stepwisely as shown by the double-dot-and-dash lines $\alpha$ and $\beta$ in FIG. 4, and, by the stepwise opening of this holding rack 70, the tubular desiccated product (in bulk form) is made to drop stepwisely. In contrast to this, the jet nozzles 82, 82, . . . for blowing clean air under its compressed state of about 10 atm. or so against the desiccated product are provided in the desiccated product receptacle 72, as shown in FIG. 4, thereby crushing the desiccated product, which is dropping down, by the crushing device w comprising the holding rack 70 and the jet nozzles 82, 82, . . . . In this way, the crushing of the desiccated product becomes able to be done within the desiccated product receptacle 72 which is integrally connected to the lower surface side of the shell 60.

Further, the discharge port formed in the bottom surface of this product receptacle 72 is hermetically connected to a hopper 50 of the comminuting device g which is constructed with the hopper 50, a jet mill 52 and a cyclone 53.

As in the embodiment of FIG. 3, the crushing and comminuting means to be provided for implementation of the crushing operation of the desiccated product obtained from the liquid material, which has been freeze-dried in the tubes 61, 61, . . . within the shell 60, may be done by providing the crushing device w for mechanically crushing the desiccated product, which falls downward into the bottom part of the product receptacle 72 installed on the lower surface side of the shell 60 in its state of being maintained under the vacuum condition.

In this case, the air-tight connection is made to be realized in the hopper 50 of the comminuting device g by means of a special valve 83 provided thereon with a material forwarding device.

With such hermetic connection, the whole process steps of: adjusting the starting materials into the liquid material; distributively pouring the liquid material; desiccating the liquid material; crushing and comminuting the thus desiccated material; and finally obtaining the product in powder form, are carried out in such a fashion that they are connected substantially continuously within the main body of the freeze-drying device, whereby it becomes possible to securely attain the maintained conditions of sterility and the prevention of risk of contamination, at the lowest cost for the facility.

Figure 5:
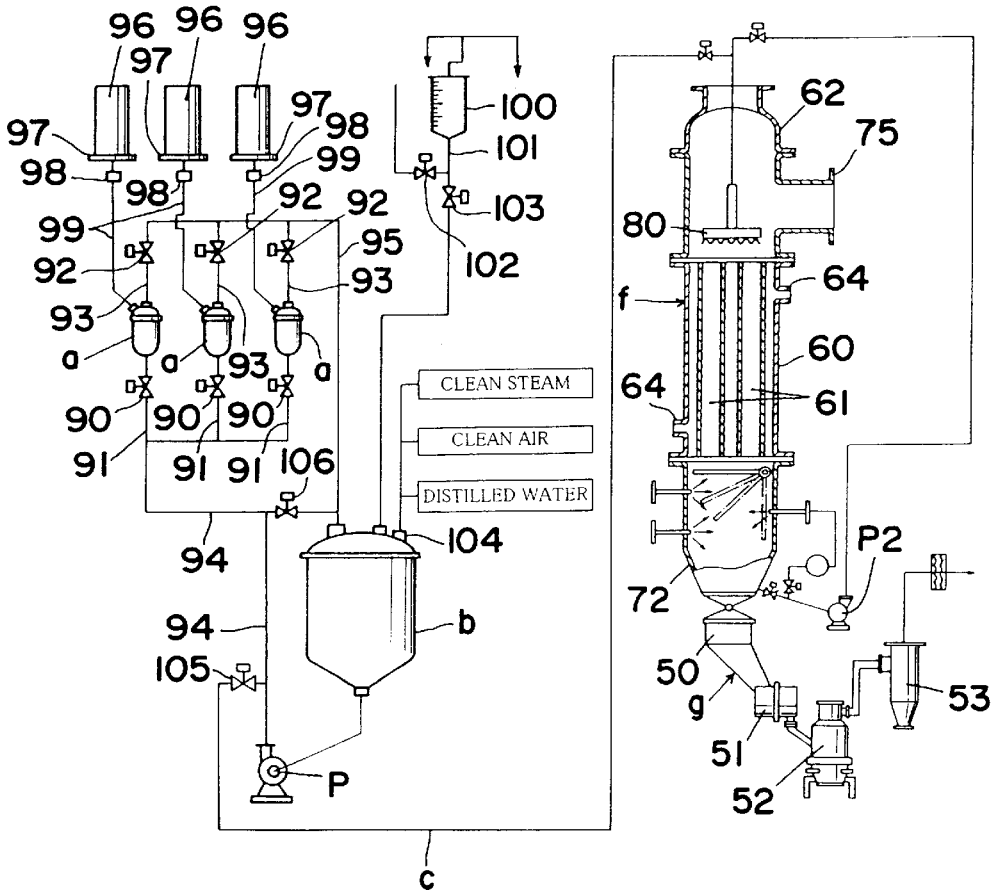
FIG. 5 is a schematic developed diagram of another embodiment of the present invention, with the starting material adjusting device being modified.

In the next place, FIG. 5 illustrates another embodiment, in which the material adjusting apparatus A is made to be operated rapidly and accurately for adjusting the starting materials and the solvent into the liquid material, when the liquid material is to be obtained from the starting materials and the solvent.

In FIG. 5, a reference letter (a) designates a plurality of material blending tanks arranged in parallel each other, and a reference letter (b) designates an adjusting tank. The blending tanks a, a, . . . are each formed in a tightly closed vessel with its inner part being compressible, and fixedly held on and by a supporting frame. On the bottom part of each of the blending tanks a, a, . . . , there is connected a lower pipeline 91, which is controlled for its opening and closing by means of a valve mechanism 90 to be actuated individually. In the same manner, on the upper part of these blending tanks, there are communicatively connected upper pipelines 93, 93, . . . , each being controlled for its opening and closing operations by a valve mechanism 92 to be actuated individually. And, these lower pipelines 91, 91, . . . are connected in parallel with the pipeline 94 at the outlet side, which is connected to the outlet port of the pump P, where an intake port is joined to the discharge port of the abovementioned adjusting tank b. On the other hand, the upper pipelines 93, 93, . . . are connected in parallel with a de-aerating pipeline 95, which is connected to the upper part of the abovementioned adjusting tank b.

A reference numeral 96 designates a starting materials storage tanks, each being supported on a weighing mechanism 97 such as load cell, etc., so as to serve for dual purposes as a weighing tank. Each feeding port of the starting materials storage tanks is communicatively connected with the abovementioned material blending tanks a, a, . . . juxtaposed each other through feeding pipes 99, 99, . . . , each being provided with a shutter 98 to be controlled individually for its opening and closing.

A reference numeral 100 designates a solvent tank which is formed in a weighing cup with a definite capacity. An outlet pipe 101, which serves as the material feeding pipe connected to the bottom part of the solvent tank, is joined with a distilled water reserving tank or a city water tap through an opening and closing valve 102. The solvent tank is also connected to the upper part of the abovementioned adjusting tank b through a separate opening and closing valve 103.

The abovementioned adjusting tank b is formed in a large-sized, pressure-resistant, hermetically sealed vessel, on the upper surface side of which there is provided a washing port 104, through which washing water, clean air, and clean steam are made to be fed into the adjusting tank b in a switchable manner.

The pipeline 94 at the outlet side connected to the abovementioned lower pipelines 91, 91, . . . is connected to the pipeline c for sending out the liquid material, which is made in the material adjusting tank b, into the distributive feeding step of the freeze-drying device f through a change-over valve 105. Further, a de-aerating valve 106 is connected at a position upstream of the abovementioned change-over valve 105 so as to be joined with the de-aerating pipe 95, which is connected to the upper pipelines 93, 93, . . . , by the opening of this de-aerating valve. On the other hand, the outlet side of the pump P is made to be communicatively connected to the pipeline c which is communicated into the shell 60 of the freeze-drying device f, by the change-over of the valve 105.

The starting materials adjusting apparatus A of such construction is operated in such a manner that, when the starting materials are to be adjusted into the liquid material of a predetermined composition, predetermined quantities of such starting materials are weighed and fed into each of the material blending tanks a, a . . . , while the solvent is weighed in a predetermined quantity and filled in the material adjusting tank b.

Subsequently, from the abovementioned state, the valve mechanisms 92, 92, . . . to the side of the upper pipelines 93, 93, . . . are each closed, and the valve mechanisms 90, 90, . . . to the side of the lower pipelines 91, 91, . . . are each opened; in addition, the de-aerating valve 106 is closed to bring about a state, wherein the change-over valve 105 is actuated in such a manner that the outlet port of the pump P becomes communicatively connected to the pipeline 94 to the outlet side, thereby starting the pump operation.

Figure 6:
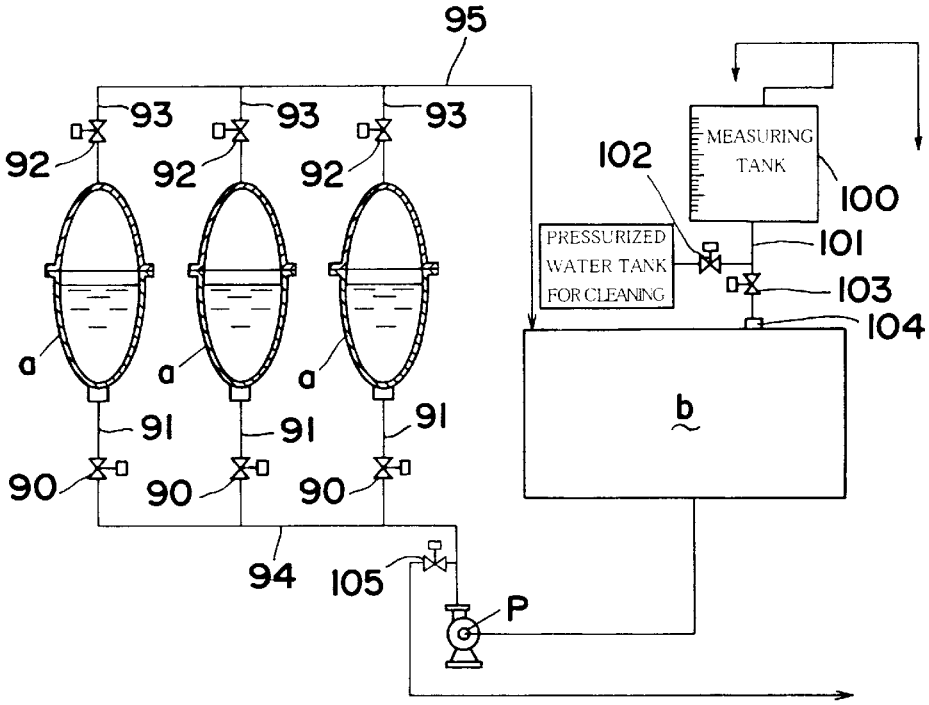
FIG. 6 is a schematic explanatory diagram for the function of the starting material adjusting device as illustrated in FIG. 5.

In this manner, the solvent filled in the material adjusting tank b is fed under pressure into each of the material blending tanks a, a, . . . , at which time the air existing in each of the material blending tanks a, a, . . . is pushed upward to the upper part in the material blending tank by the solvent which is fed thereinto, as shown in FIG. 6, and is compressed to a pressure level of about 10 atm. to assume a state of being compressed by the continued operation of the pump P, hence this pump continues its operation for a certain definite period of time until the air attains its state of being compressed to a high pressure.

As soon as the feeding of the solvent under pressure by means of this pump P for a certain definite period of time is terminated, the pump P stops its operation, whereupon the solvent and the starting materials dissolved in the solvent, both of which have been sent into each of the material blending tanks a, a, . . . , are pushed out from the interior of the material blending tanks a, a, . . . . by the pressure of the air which has been compressed in each of the material blending tanks a, a, . . . , and inversely flows in and through the pipeline 94 at the outlet side to thereby flow into the material adjusting tank b by way of the pump P which has ceased its operation. This pump P is then caused to restart its operation, and the same process steps are repeated for several times.

In the next place, the valve mechanisms 92, 92, . . . , which are connected to the upper pipelines 93, 93, . . . are opened, and the pump P is actuated. Then, the solvent in the material adjusting tank b and the materials dissolved therein are circulated in such a manner as to be returned to the material adjusting tank b by the pumping force from the pump P through the material blending tanks a, a, . . . . During this circulation, the starting materials are completely dissolved into the solvent by the agitating power of this pump P, and also, the starting materials which remain adhered onto the inner wall of each of the material blending tanks a, a, . . . are washed out by the circulating solvent to be completely dissolved therein. In this way, the thus adjusted liquid material is supplied by the operation of the pump P, through the pipeline c, into the shell 60 which constitutes the desiccating chamber of the freeze-drying device f.

This material blending means may also be in such a construction that the material blending tanks a, a, . . . are each communicatively connected to the adjusting tank b so that the material adjusting operations can be done for each starting material, whereby dissolution of the starting materials into the solvent becomes more perfectly carried out.

This material blending means has its advantage such that, owing to its non-use of the agitator for the dissolution of the starting materials into the solvent, mixing into the liquid material of foreign matters generated due to breakage of the agitator, etc. can be prevented without failure, and moreover, washing of the material can be done easily and adequately.

As has been described in the foregoing, the freeze-drying apparatus according to the present invention, for obtaining foodstuffs, medicaments, etc. by freeze-drying of the liquid material, is of such a construction that, since, in the starting materials adjusting step, the liquid material obtained from the starting materials and the solvent in the material adjusting tank, followed by sending out the liquid material through the pipeline, is directly forwarded into the shell of a cylindrical shape, which constitutes the desiccating chamber for shell-tube type freeze-drying device, and then such liquid material is distributively fed into a plurality of pipes which are mutually juxtaposed in the upright position in the shell to cause it to freeze in frozen layers, the process steps: from the material adjusting step for adjusting the liquid material upto the charging of the thus adjusted liquid material into the desiccating chamber of the freeze-drying device can be substantially done in the main body of the freeze-drying apparatus, with the consequence that the maintenance of the freeze-drying apparatus in its sterilized condition and isolation of the freeze-drying apparatus from the external atmosphere for the purpose of preventing it from the risk of contamination can be securely done. And, the desiccated product obtained from the liquid material, which has completed its freeze-drying, is dropped into the desiccated product receptacle which is contiguously provided on the lower surface side of the shell in such a manner that the apparatus may be maintained in its vacuum state, where the desiccated product is subjected to the crushing and comminuting treatment. Therefore, the removing and grinding of the desiccated product can be done within the main body of the freeze-drying device in the state of its being substantially perfectly isolated from the external atmosphere. Further, since the bottom part of this desiccated product receptacle is hermetically connected with the hopper of the crushing and comminuting device through the special valve provided with the forwarding device, the total process steps can be joined together, as the perfectly closed system, i.e., from the adjusting of the starting materials upto the crushing and comminuting of the desiccated product, with the consequence that those devices such as isolating device, loading device, and so forth, which were conventionally provided at the connecting position between the adjacent process steps, become no longer required, thereby contributing to remarkable reduction in cost for constructing the facility.

Furthermore, in the material adjusting step, if and when the feeding of the starting materials into the material blending tanks a, a, . . . and the feeding of the solvent into the starting materials adjusting tank b are carried out automatically, without human power, as shown in FIG. 5, the whole process steps from adjusting of the starting materials upto the crushing and comminuting of the desiccated product can be done in their state of being isolated from external atmosphere, and being dispensable with various expedients such as the clean room, the washing and sterilizing device for the vessels and containers, the filling devices for various solutions, the isolating device, and the loading device. In this consequence, the cost for constructing the whole facility can be remarkably reduced, and also the whole facility can be made as the closed system, where the perfectly sterilized condition is secured and the facility is prevented from the risk of contamination. Thus, owing to such perfect sterilization, the powder product which has been desiccated in bulky form can be directly filled into desired containers so as to meet the purpose of customers' intended use.

Moreover, in view of the fact that, as mentioned in the foregoing, the entire system including the starting materials adjusting tanks upto the freeze-drying apparatus, and the pipelines as well can be constructed in the tightly closed condition, it becomes possible to carry out the stationary washing (CIP) by the pipeline connection of the entire system. Also, by the introduction of pure steam, it becomes possible to carry out the stationary sterilization with steam (SIP) can be done, with the result that the whole facility can be readily accredited to various safety standards such as HACCP, GMP, and so forth.

Although the present invention has been described in specific detail in the foregoing with reference to particular embodiments thereof, it should be noted that the invention is not limited to these embodiments alone, but any changes and modifications may be made without departing from the spirit and scope of the invention as recited in the appended claims.

What is claimed is:

1. A method for freeze-drying foodstuffs and medicaments comprising:

a. converting the foodstuffs and medicaments to a liquid material by adding a solvent therefore in a starting material adjusting apparatus comprising material blending tanks and a material adjusting tank;

b. introducing the liquid material through a pipeline into a shell comprising a desiccating chamber of a shell-tube freeze-drying device so as to immediately and distributively feed the liquid material into a plurality of tubes which are juxtaposed with respect to each other in an upright position in the shell to cause the liquid material to freeze in a tubular layer;

c. after the liquid material is freeze-dried by the freeze-drying device, subjecting the desiccated product in tubular form, dropping from the tubes in the shell, to crushing and comminuting treatment by a comminuting device to thereby obtain a powder product.

2. The method according to claim 1 wherein the starting materials are selected from the group consisting of foodstuffs and medicaments.

3. A method for freeze-drying starting materials comprising the steps of:

a. converting the starting materials and a solvent therefore into a liquid material using a material adjusting device comprising blending tanks and an adjusting tank;

b. introducing the liquid material through a pipeline into a shell comprising a desiccating chamber of a shell-tube freeze-drying device so as to immediately and distributively feed the liquid material into a plurality of tubes which are juxtaposed with respect to each other in an upright position within the shell to cause the material to freeze in a tubular layer;

c. after the liquid material is freeze-dried by the freeze-drying apparatus, subjecting the thus desiccated product in tubular form which drops from the tubes within the shell to a crushing and comminuting treatment by a crushing device disposed in a desiccated product receptacle disposed below the shell in continuation of the shell and maintained under vacuum, followed by transporting the crushed product into a comminuting device connected to a bottom surface side of a desiccated product receptacle for comminuting to produce a powder product.

4. The method according to claim 3 wherein the starting materials are selected from the group consisting of foodstuffs and medicaments.

5. A freeze-drying apparatus comprising:

a. a plurality of tubes in which an atomizing nozzle pipe is disposed at the axial center position within the inner bore of each tube, said tubes being juxtaposed with respect to each other in an upright position with a shell;

b. the shell comprising a desiccating chamber of a shell-tube freeze-drying device;

c. a multitude of atomizing holes in the cylindrical wall of each of the tubes; the downstream side of a pipeline which guides liquid material from a starting material adjusting tank of the material adjusting apparatus being connected to the upper end side of the atomizing nozzle pipes directly or through an atomizing nozzle.

6. A freeze-drying apparatus comprising:

a. a plurality of supporting rods disposed at the axial center position within the inner bore of each of a plurality of tubes, said tubes being juxtaposed with respect to each other in an upright position within a shell;

b. the shell comprising a desiccating chamber of a shell-tube freeze-drying device;

c. a plurality of holding racks formed in an opening-and-closing butterfly valve shape and held at the lower end of each of the supporting rods to hold a lower end part of each of said supporting rods to hold the lower layer of liquid material which has been freeze-dried in each tube; and d. an actuating wire or a pneumatically operated actuator connected to each holding rack, whereby said holding racks rotate to open and close the holding racks.

7. A freeze-drying apparatus comprising:

a. a desiccated product receptacle for receiving therein desiccated product from liquid material which has been dried by freezing liquid material on the wall surface of a plurality of tubes which are juxtaposed with respect to each other in an upright position within a shell;

b. said desiccated product receptacle being disposed below the shell which comprises a desiccating chamber of a shell-tube freeze-drying device;

c. the desiccated product receptacle connected to the shell and maintained under vacuum; and d. a crushing device for crushing and comminuting the desiccated product dropping into the desiccated product receptacle from the tubes within the shell;

e. the bottom surface side of the desiccated product receptacle being connected in an airtight manner to a hopper of a grinding apparatus through a valve provided with a material forwarding apparatus.

* * * * *